US006037091A

United States Patent [19]

MacLeod et al.

[11] Patent Number: 6,037,091

[45] Date of Patent: Mar. 14, 2000

[54] CARRIER WITH FERROCENE CONTAINING POLYMER

[75] Inventors: Paula J. MacLeod, Etobicoke; Richard P. N. Veregin, Mississauga, both of Canada; Charles H. Honeyman, Allston, Mass.

[73] Assignee: Xerox Corporation, Stamford, Conn.

[21] Appl. No.: 09/385,506

[22] Filed: Aug. 30, 1999

[51] Int. Cl.[7] ..... G03G 9/107; G03G 9/113

[52] U.S. Cl. ..... 430/106.6; 430/108; 430/137

[58] Field of Search ..... 430/106.6, 108, 430/137

[56] References Cited

U.S. PATENT DOCUMENTS

| | | | |
|---|---|---|---|
| 3,533,835 | 10/1970 | Hagenbach et al. | 430/111 |
| 3,590,000 | 6/1971 | Palermiti et al. | 430/110 |
| 3,658,500 | 4/1972 | Hagenbach | 430/107 |
| 3,798,167 | 3/1974 | Kukla et al. | 430/109 |
| 3,918,968 | 11/1975 | Kukla et al. | 430/108 |
| 3,922,382 | 11/1975 | Kukla et al. | 430/137 |
| 3,939,086 | 2/1976 | Hagenbach | 430/108 |
| 4,233,387 | 11/1980 | Mammino et al. | 430/137 |
| 4,238,558 | 12/1980 | Ziolo | 430/108 |
| 4,264,697 | 4/1981 | Perez et al. | 430/107 |
| 4,310,611 | 1/1982 | Miskinis | 430/107 |
| 4,397,935 | 8/1983 | Ciccarelli et al. | 430/110 |
| 4,434,220 | 2/1984 | Abbott et al. | 430/108 |
| 4,810,611 | 3/1989 | Ziolo et al. | 430/106.6 |
| 4,935,326 | 6/1990 | Creatura et al. | 430/108 |
| 4,937,166 | 6/1990 | Creatura et al. | 430/108 |

*Primary Examiner*—Roland Martin
*Attorney, Agent, or Firm*—E. O. Palazzo

[57] ABSTRACT

A carrier comprised of a core and thereover a ferrocene containing polymer.

30 Claims, No Drawings

CARRIER WITH FERROCENE CONTAINING POLYMER

PENDING APPLICATIONS

Illustrated in applications U.S. Ser. No. 140,437 now U.S. Pat. No. 5,945,244; U.S. Ser. No. 140,524 pending; U.S. Ser. No. 140,439 now U.S. Pat. No. 6,010,812; U.S. Ser. No. 140,998 now U.S. Pat. No. 5,935,750; and U.S. Ser. No. 140,594, now U.S. Pat. No. 6,004,712 and the disclosures of each of which are totally incorporated herein by reference, are carrier particles comprised, for example, of a core with coating thereover of polystyrene/olefin/dialkylaminoalkyl methacrylate, polystyrene/methacrylate/dialkylaminoalkyl methacrylate, and polystyrene/dialkylaminoalkyl methacrylate. More specifically, there is illustrated in copending application U.S. Ser. No. 140,437 a carrier comprised of a core, and thereover a polymer of styrene, an olefin and a dialkylaminoalkyl methacrylate; in copending application U.S. Ser. No. 140,524 a carrier composition comprised of a core and thereover a polymer of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/dialkyl aminoethyl methacrylate, or (4) polystyrene/alkyl acrylate/alkyl hydrogen aminoethyl methacrylate; in copending application U.S. Ser. No. 140,439 a carrier comprised of a core and a polymer coating of (1) styrene/monoalkylaminoalkyl methacrylate or (2) styrene/dialkylaminoalkyl methacrylate; in copending application U.S. Ser. No. 140,594 a carrier comprised of a core and thereover a polymer of (1) methylmethacrylate and a monoalkyl aminoalkyl methacrylate, or (2) a polymer of methylmethacrylate and dialkylaminoalkyl methacrylate, and in copending application U.S. Ser. No. 140,998 a carrier comprised of a core and a polymer coating containing a quaternary ammonium salt functionality.

In copending application U.S. Ser. No. 784,633 pending, the disclosure of which is totally incorporated herein by reference, there is disclosed a polymerization process for the preparation of toner polymers and wherein there is selected for the process a transition metal catalyst, such as ferrocene, ferrocenium salts, and more specifically 1,1-dicyano-2-ferrocenylethene.

The appropriate components and processes of the above recited copending applications may be selected for the present invention in embodiments thereof.

BACKGROUND OF THE INVENTION

This invention is generally directed to developer compositions, and more specifically, the present invention relates to developer compositions with coated carrier components, or coated carrier particles that can be prepared by, for example, dry powder processes. More specifically, the present invention relates to compositions, especially carrier compositions compromised of a core, and thereover a ferrocene containing polymer, or polymers.

In embodiments of the present invention, the carrier particles are comprised of a core with a coating thereover of a ferrocene containing polymer such as a poly (ferrocenyl silane), or a poly(ferrocenyl phosphane), or more specifically poly(ferrocenyl dialkyl such as methylsilane) or poly (ferrocenyl aryl, such as phenylphosphane), and wherein the polymers selected can be conductive and thus there is avoided the need to add to the polymer a conductive component such as carbon black. The carrier may include the polymer coating thereover in admixture with other suitable polymers, and more specifically, with a second polymer, such as a fluoropolymer, polymethylmethacrylate, poly(urethane), especially a crosslinked polyurethane, such as a poly(urethane)polyester and the like, and moreover, the copolymer coating may contain a conductive component, such as carbon black, and which conductive component is preferably dispersed in the polymer coating. With the conductive component, there can be enabled carriers with increased developer triboelectric response at relative humidities of from about 20 to about 90 percent, improved image quality performance, excellent high conductivity ranges of from about $10^{-10}$ to about $10^{-7}$ (ohm-cm)$^{-1}$, and the like. An important advantage associated with the carriers of the present invention with the polymer coating thereover include a high triboelectrical charge, for example a carrier tribo range of from about a plus (positive charge) or negative charge of about 10 to about 70, and preferably from about 15 to about 50 microcoulombs per gram, and most preferably from about 15 to 40 microcoulombs per gram and which carriers possess a conductivity of, for example, from about $10^{-6}$ to about $10^{-13}$ and preferably from about $10^{-8}$ to about $10^{-11}$ and which conductivity is measured by a magnetic brush conducting cell.

The carrier particles of the present invention can be selected for a number of different imaging systems and devices, such as xerographic copiers and printers, inclusive of high speed color xerographic systems, printers, digital systems, combination of xerographic and digital systems, and wherein colored images with excellent and substantially no background deposits are achievable. Developer compositions comprised of the carrier particles illustrated herein and prepared, for example, by a dry coating process are generally useful in electrostatographic or electrophotographic imaging systems, especially xerographic imaging and printing processes, and digital processes. Additionally, the invention developer compositions comprised of substantially conductive carrier particles are useful in imaging methods wherein relatively constant conductivity parameters are desired. Furthermore, in the aforementioned imaging processes the triboelectric charge on the carrier particles can be preselected, which charge is dependent, for example, on the polymer composition and dispersant component applied to the carrier core, and optionally the type and amount of the conductive component selected.

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith, especially at a variety of relative humidities.

Carrier particles for use in the development of electrostatic latent images are described in many patents including, for example, U.S. Pat. No. 3,590,000, the disclosure of which is totally incorporated herein by reference. These carrier particles can contain various cores, including steel, with a coating thereover of fluoropolymers, and terpolymers of styrene, methacrylate, and silane compounds. A number of these coatings can deteriorate rapidly, especially when selected for a continuous xerographic process where a portion of, or the entire coating may separate from the carrier core in the form of, for example, chips or flakes, and which resulting carrier can fail upon impact, or abrasive contact with machine parts and other carrier particles. These flakes or chips, which cannot generally be reclaimed from the developer mixture, usually adversely effect the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity, and relatively low triboelectrical values.

There is illustrated in U.S. Pat. No. 4,233,387, the disclosure of which is totally incorporated herein by reference, coated carrier components comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the resin particles to melt and fuse on the carrier core.

There is illustrated in U.S. Pat. Nos. 4,937,166 and 4,935,326, the disclosures of which are totally incorporated herein by reference, carrier containing a mixture of polymers, such as two polymers, not in close proximity in the triboelectric series. Moreover, in U.S. Pat. No. 4,810,611, the disclosure of which is totally incorporated herein by reference, there is disclosed the addition to carrier coatings of colorless conductive metal halides in an amount of from about 25 to about 75 weight percent, such halides including copper iodide, copper fluoride, and mixtures thereof. The appropriate components and processes of the '166 and '326 patents may be selected for the present invention in embodiments thereof. The carriers of the present invention are advantageous over this prior art in that there can be enabled high positive triboelectric charge on the carrier particles, up to about a 150 negative triboelectric charge is imparted to the toner particles developed onto a photoreceptor in, for example, a xerographic development environment. Further, the full range of electrical properties of the carrier particles can be achieved at high triboelectric charging values, from carrier conductivities of about $10^{-17}$ mho/cm to about $10^{-6}$ mho/cm, that is, from the insulative to the conductive regime, and the carrier triboelectric charge and carrier conductivity can be varied and preselected.

With further reference to the prior art, carriers obtained by applying insulating resinous coatings to porous metallic carrier cores using solution coating techniques are undesirable from many viewpoints. For example, the coating can reside primarily in some of the pores of the carrier cores, rather than at the surfaces thereof; and therefore, is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves processing excessive quantities of solvents, and further, usually these processes result in low product yields. Also, solution coated carrier particles, when combined and mixed with finely divided toner particles, provide in some instances triboelectric charging values which are too low for many uses. The powder coating processes of the present invention overcome or minimize these disadvantages, and further enable developers that are capable of generating high triboelectric charging values with finely divided toner particles; and also wherein the carrier particles in embodiments are of substantially constant conductivity.

When resin coated carrier particles are prepared by powder coating process the majority of the coating materials are fused to the carrier surface thereby reducing the number of toner impaction sites on the carrier. Additionally, there can be achieved with the process of the present invention and the carriers thereof, independent of one another, desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected high triboelectric charging characteristics and/or conductivity values in a number of different combinations. Thus, for example, there can be formulated in accordance with the invention of the present application developers with conductivities as determined in a magnetic brush conducting cell of from about $10^{-6}$ (ohm-cm)$^{-1}$ to about $10^{-17}$ (ohm-cm)$^{-1}$, preferably from about $10^{-10}$ (ohm-cm)$^{-1}$ to about $10^{-6}$ (ohm-cm)$^{-1}$, and most preferably from about $10^{-8}$ (ohm-cm)$^{-1}$ to about $10^{-6}$ (ohm-cm)$^{-1}$, and high carrier triboelectric charging values of from about 20 to about 150, and, for example, from a positive about 45 to a positive about 90 microcoulombs per gram on the carrier particles as determined by the known Faraday Cage technique. Thus, the developers of the present invention can be formulated with conductivity values in a certain range with different triboelectric charging characteristics by, for example, maintaining the same total coating weight on the carrier particles.

Other U.S. patents that may be of interest include U.S. Pat. No. 3,939,086, which illustrates steel carrier beads with polyethylene coatings, see column 6; U.S. Pat. Nos. 4,264,697; 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY OF THE INVENTION

It is a feature of the present invention to provide toner and developer compositions with carrier particles containing polymer coatings.

In another feature of the present invention there are provided dry coating processes for generating carrier particles of substantially constant conductivity parameters.

In yet another feature of the present invention there are provided dry coating processes for generating carrier particles of substantially constant conductivity parameters, and high triboelectric charging values.

In yet a further feature of the present invention there are provided carrier particles with high tribo values and wherein the carrier includes thereover a ferrocene containing polymer, or a coating of two polymers wherein the second polymer is a copolymer of polymethylmethacrylate, and poly(urethane), and wherein the coating may contain therein a conductive component of, for example, carbon black.

Aspects of the present invention relate to a carrier comprised of a core and thereover a ferrocene containing polymer; a carrier comprised of a core and thereover ferrocene containing polymers; a carrier wherein the ferrocene containing polymer is poly(ferrocenyl dimethylsilane), poly (ferrocenyl phenylphosphane), or mixtures thereof; a carrier wherein the ferrocene is a ferrocenylsilane, a mixture of poly(ferrocenyl dimethylsilane) and poly(ferrocenyl phenylphosphane), or a mixture of poly(ferrocenyl dimethylsilane) poly(ferrocenyl phenylphosphane), and poly(ferrocenyl dimethylgermane); a carrier wherein the polymer possesses an $M_w$ of from about $10^5$ to about $10^7$ and an $M_n$ of from about $10^5$ to about $10^7$; a carrier wherein the polymer coating weight is from about 0.1 to about 20 weight percent; a carrier wherein the polymer coating weight is from about 1 to about 3 weight percent; a carrier wherein the polymer contains a conductive component; a carrier wherein the conductive component is a metal oxide, or is carbon black; a carrier wherein the conductive component is carbon black selected in an amount of from about 10 to about 60 weight percent; a carrier wherein the core is a metal, a metal oxide, or a ferrite; a carrier with a triboelectric charge of from about 15 to about a positive 50 microcoulombs per gram; a carrier with a triboelectric charge of from about 15 to about 30 microcoulombs per gram; a developer comprised of the carrier illustrated herein and toner; a developer wherein the toner is comprised of thermoplastic resin and colorant; a developer wherein the colorant is a pigment and the resin is a styrene copolymer, or a polyester; a developer comprised of a (1) carrier core and coating layer of a ferrocene containing polymer, and (2) a toner; a developer wherein the carrier core is selected from the group consisting of iron, ferrites, steel and nickel; a developer with a carrier triboelectric charge of from about a positive 15 to about a positive 50 microcoulombs per gram, and a toner triboelectric charge of from about a negative 15 to about a negative 50 microcoulombs per gram; a developer with a carrier triboelectric charge of from about a negative 15 to about a negative 50 microcoulombs per gram, and a toner triboelectric charge of from about a positive 15 to about a positive 50 microcoulombs per gram; a carrier wherein there is included as a coating a second polymer of a copolymer of methylmethacrylate/dimethylaminoethyl methacrylate; a copolymer of methylmethacrylate and tertiary-butylaminoethyl methacrylate; a copolymer of methylmethacrylate and diethylaminoethyl methacrylate; a copolymer of methylmethacrylate and disopropylaminoethyl methacrylate; or a copolymer of methylmethacrylate and an alkylaminoethyl methacrylate; a carrier wherein the carrier contains a second polymer coating; a carrier wherein the second coating is comprised of a styrene acrylate, a styrene methacrylate, or a fluoropolymer; a carrier wherein the second coating is comprised of a polyurethane; a carrier wherein the second coating is comprised of a polyurethane/polyester; an imaging process which comprises developing an image with the developer illustrated herein; a process for the preparation of the carrier illustrated herein by the dry mixing and heating of the core and the coating; a carrier wherein the ferrocene polymer is of the formula Fc—Si(RR')

wherein Fc is ferrocene, and R and R' are each alkyl, or aryl; a carrier wherein the ferrocene polymer is of the formula FcPR wherein Fc is ferrocene, P is phosphorous, and R is alkyl or aryl; a carrier wherein the ferrocene polymer is poly(ferrocenyl dimethyl silane), poly(ferrocenyl di-n-hexyl silane), poly(ferrocenyl phenyl phosphone), or mixtures thereof; a carrier comprised of a core and thereover a ferrocene containing polymer inclusive of polymers of ferrocenes, ferrocenyl silanes, ferrocenyl germanes, ferrocenyl phosphanes, ferrocenyl phosphane sulfides, ferrocenyl sulfides, polyferrocenyl alkenes, and ferrocenyl persulfides, vinylferrocene, copolymer,s such as poly(arylene-siloxane-ferrocene), polyferrocene copolymers with dimethylsiloxane or with—(methylphenylsilane)$_n$ oligomers, where n is a number such as 1 to about 10, and ferrocene containing polyesters. Also suitable are the above polymers with alkyl, aryl, alkoxy, aryloxy, hydroxyl, aceto, amino, phenyl, sulfonate, phosphonate, nitro, and ferrocenyl substituents. More specific examples of ferrocene carrier coatings include —[Fc—Si(RR')]—, wherein

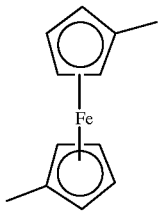

R and R' may be an alkyl, or aryl, a cenyl substituent, such as —[Fc—Si$(CH_3)_2$]—, poly(ferrocenyl phosphanes), —[Fc—P(R)]—, where Fc=ferrocene, R may be an alkyl or aryl substituent, such as poly(ferrocenyl phenylphosphane), —[Fc—P(phenyl)]—, suitable are specific block copolymers, such as —[Fc—Si$(CH_3)_2]_m$—[Si$(CH_3)_2$O$]_n$—, and random copolymers of —[Fc—Si$(CH_3)_2$]—[Si$(CH_3)_2$O$]_4$—; a carrier wherein the polymer coating weight is from about 1 to about 3 weight percent; a carrier wherein the polymer coating contains a conductive component; a carrier wherein the conductive component is a metal oxide, or is carbon black; a carrier wherein the conductive component is carbon black selected in an amount of from about 10 to about 60 weight percent; a carrier wherein the core is a metal, a metal oxide, or a ferrite; a developer comprised of a coated carrier and toner; a developer wherein the toner is comprised of thermoplastic resin and colorant; a developer wherein the colorant is a pigment and the toner resin is a styrene copolymer, or a polyester; a developer comprised of a (1) carrier core and coating layer of a ferrocene containing polymer, and (2) a toner; a developer wherein the carrier core is selected from the group consisting of iron, ferrites, steel and nickel; a carrier wherein the carrier contains a second polymer coating; a carrier wherein the second coating is comprised of a styrene acrylate, a styrene methacrylate, or a fluoropolymer; a carrier wherein the second coating is comprised of a polyurethane and which polyurethane optionally contains dispersed therein conductive components; and a carrier wherein the second coating is comprised of a polyurethane/polyester with carbon black optionally dispersed therein.

The present invention is directed to, for example, developer compositions comprised of toner particles, and carrier particles prepared, for example, by a powder coating process, and wherein the carrier particles are comprised of a core with a ferrocene containing polymer coating thereover; carrier particles prepared by mixing low density porous magnetic, or magnetically attractable metal core carrier particles with from, for example, between about 0.05 percent and about 3 percent by weight, based on the weight of the coated carrier particles, of a ferrocene containing polymer, and which polymer may optionally contain dispersed therein carbon black or a similar conductive component, until adherence thereof to the carrier core by mechanical impaction or electrostatic attraction; heating the resulting mixture of carrier core particles and polymer to a temperature, for example, of between from about 200° F. to about 625° F., preferably about 400° F. for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter.

Examples of specific ferrocene containing polymers, where Fc is a ferrocene moiety are poly(ferrocenyl dimethylsilane), —[Fc—$Si(CH_3)_2]_n$— with an $M_n$ and $M_w>10^5$, available from Professor Ian Manners, Department of Chemistry, University of Toronto; poly(ferrocenyl di-n-hexylsilane), —[Fc—$Si(CH_2)_5CH_3)_2]_n$—; poly(ferrocenyl phenylphosphane), —[Fc—P(phenyl)]$_n$— available from Professor Ian Manners, Department of Chemistry, University of Toronto; and blends thereof, such as a 70:30 weight percent blend of poly(ferrocenyl dimethylsilane) with poly (ferrocenyl phenylphosphane), available from Professor Ian Manners, Department of Chemistry, University of Toronto, —[Fc—$Ge(CH_3)_2]_n$—, —[Fc—$Ge(CH_2CH_3)_2]_n$—, —[Fc—$Ge(CH_2CH_2CH_2CH_3)_2]_n$—, —[Fc—Ge (phenyl)$_2]_n$—, and —[Fc]$_n$—. The polymer coating weight is, for example, from about 0.3 weight percent to about 10 weight percent, and preferably from about 0.5 weight percent to about 5 weight percent.

Second carrier coating polymer examples are, for example, a fluorocarbon, polymethylmethacrylate (PMMA), a thermosetting polymer, such as a thermosetting polyurethane, a polyester, a styrene based polymer, or second a nitrogen-containing copolymer, and wherein the first polymer is selected in an amount of from about 1 to about 100, or from about 10 to about 75 weight percent, based on the total weights of all polymers and conductive components optionally present in the carrier, and the second polymer is selected in an amount of from about 99 to about 0, or from about 90 to about 25 weight percent, based on the total weights of all polymers and conductive components present in the carrier; and wherein the carrier core is a metal, a ferrite, a metal oxide, and the like, inclusive of known carrier cores.

Various suitable solid core carrier materials can be selected for the carriers and developers of the present invention. Characteristic core properties of importance include those that will enable the toner particles to acquire a positive charge or a negative charge, and carrier cores that will permit desirable flow properties in the developer reservoir present in the xerographic imaging apparatus. Also of importance with regard to the carrier core properties are, for example, suitable magnetic characteristics that will permit magnetic brush formation in magnetic brush development processes; and also wherein the carrier cores possess desirable mechanical aging characteristics; and further, for example, a suitable core surface morphology to permit high electrical conductivity of the developer comprising the carrier and a suitable toner. Examples of carrier cores that can be selected include iron or steel, such as atomized iron or steel powders available from Hoeganaes Corporation or Pomaton S.p.A (Italy), ferrites such as Cu/Zn-ferrite containing, for example, about 11 percent copper oxide, 19 percent zinc oxide, and 70 percent iron oxide, available from D.M. Steward Corporation or Powdertech Corporation, Ni/Zn-ferrite available from Powdertech Corporation, Sr (strontium)-ferrite containing, for example, about 14 percent strontium oxide and 86 percent iron oxide, available from Powdertech Corporation Ba-ferrite, magnetites, available, for example, from Hoeganaes Corporation (Sweden), nickel, mixtures thereof, and the like. Preferred carrier cores include ferrites, and sponge iron, or steel grit with an average particle size diameter of, for example, from between about 30 microns to about 400 microns, and preferably from about 50 to about 50 microns.

Examples of further second polymers selected for the carrier include copolymers of methylmethacrylate or methylacrylate and a monoalkyl, or dialkyl amine, such as a dimethylaminoethyl methacrylate, diethylaminoethyl methacrylate, diisopropylaminoethyl methacrylate, or t-butylaminoethyl methacrylate; and the like. Specific examples of copolymer coatings are poly (methylmethacrylate/dimethylaminoethyl methacrylate), poly(methylmethacrylate/tertiary-butylaminoethyl methacrylate), poly(methyl methacrylate/diethylaminoethyl methacrylate), poly(methyl methacrylate/diisopropylaminoethyl methacrylate), copolymers of methylmethacrylate with other monoalkyl or dialkylaminoethyl methacrylates, wherein alkyl contains, for example, from about 1 to about 25, and preferably from 1 to about 10 carbon atoms, such as methyl, ethyl, propyl, butyl, pentyl, hexyl, octyl, nonyl, and the like.

Further, examples of second polymers can include polymonoalkyl or dialkyl methacrylates or acrylates, polyurethanes, fluorocarbon polymers such as polyvinylidenefluoride, polyvinylfluoride, and polypentafluorostyrene, polyethylene, polyethylene-co-vinylacetate, polyvinylidenefluoride-co-tetrafluoroethylene, and the like, inclusive of other known suitable polymers. Other known related polymers not specifically mentioned herein may also be selected, such as those illustrated in the U.S. Pat. Nos. 4,937,166 and 4,935,326 patents mentioned herein.

A specific second polymer can be comprised of a thermosetting polymer and yet, more specifically, a poly (urethane) thermosetting resin which contains, for example, from about 75 to about 95, and preferably about 80 percent by weight of a polyester polymer, which when combined with an appropriate crosslinking agent, such as isopherone diisocyannate and initiator such as dibutyl tin dilaurate forms a crosslinked poly(urethane) resin at elevated temperatures. An example of a polyurethane is poly(urethane)/polyester polymer or Envirocron (product number PCU10101, obtained from PPG Industries, Inc.). This polymer has a melt temperature of between about 210° F. and about 266° F., and a crosslinking temperature of about 345° F. This second polymer is mixed together with the first polymer, generally prior to mixing with the core, which when fused forms a uniform coating of the first and second polymers on the carrier surface. The second polymer is present, for example, in an amount of from about 0 percent to about 99 percent by weight, based on the total weight of the first and second polymers and the conductive component in the first polymer.

The process for incorporating the polymer onto a carrier core can be sequential, a process in which one of the two polymers, when two polymers are selected, is fused to the surface in a first step and the second polymer is fused to the surface in a subsequent fusing operation. Alternatively, the process for incorporation can comprise a single fusing by heating the core and polymer or polymer coatings.

The carrier polymer coating optionally has dispersed therein in embodiments conductive components, such as metal oxides like tin oxide, conductive carbon blacks, and the like, in effective amounts of, for example, from about 0 to about 70 and preferably from about 15 to about 60 weight percent. Specific examples of conductive components include the conductive carbon black SC Ultra available from Conductex, Inc., and antimony-doped tin oxide Zelec ECP3005-XC manufactured by E.I. DuPont.

Also, the carrier coating can have incorporated therein various known charge enhancing additives, such as quaternary ammonium salts, and more specifically, distearyl dimethyl ammonium methyl sulfate (DDAMS), bis[1-[(3,5-disubstituted-2-hydroxy phenyl)azo]-3-(mono-substituted)-2-naphthalenolato(2-)]chromate(1-), ammonium sodium and hydrogen (TRH), cetyl pyridinium chloride (CPC), FANAL PINK® D4830, and the like, including those as illustrated in a number of the patents recited herein, and other effective known charge agents or additives. The charge additives are selected in various effective amounts, such as from about 0.05 to about 15, and from about 0.1 to about 3 weight percent, based, for example, on the sum of the weights of polymer, conductive additive, and charge additive components. The addition of various known charge enhancing additives can act to further increase the triboelectric charge imparted to the carrier, and therefore, further increase the negative triboelectric charge imparted to the toner in, for example, a xerographic development subsystem.

The advantages of the carriers of the present invention include in embodiments high robust carrier tribo charge of a positive value, high toner tribo charge of a negative value, excellent admix, for example from about 1 to about 30 seconds as determined in the charge spectrograph, and the like. More specifically, the toner tribo can be, for example, from about −10 to about −70, and preferably from about −15 to about −50 microcoulombs per gram, and most preferably from about −15 to about −40 microcoulombs per gram with corresponding positive tribo charges for the carrier, increased resistance of the carrier to mechanical aging in a xerographic environment and a decreased sensitivity of the carrier triboelectric value to the relative humidity of the environment. The tribo can be determined by a number of known methods, such as the use of a Faraday Cage. With respect to high toner tribo charge of a negative value, this property is important to xerographic, especially color applications, primarily because there is enabled development of toner particles into regions of the imaging member, such as a photoreceptor where strong fringe electrical fields exist, that is, at the borders of solids areas and lines. Developing toner particles through these fringe fields minimizes or eliminates the untoned part of the image which appears between two adjacent colors in an image.

Various effective suitable processes can be selected to apply the polymer, or mixture of polymers, for example from about 2 to about 5, and preferably two, of polymer coatings to the surface of the carrier particles. Examples of typical processes for this purpose include combining the carrier core material, and the polymers and conductive component by cascade roll mixing, or tumbling, milling, shaking, electrostatic powder cloud spraying, fluidized bed, electrostatic disc processing, and an electrostatic curtain. Following application of the polymers, heating is initiated to permit flow out of the coating material over the surface of the carrier core. The concentration of the coating material powder particles, and the parameters of the heating step may be selected to enable the formation of a continuous film of the coating polymers on the surface of the carrier core, or permit only selected areas of the carrier core to be coated. When selected areas of the metal carrier core remain uncoated or exposed, the carrier particles will possess electrically conductive properties. The aforementioned conductivities can include various suitable values. Generally, however, this conductivity is from about $10^{-7}$ to about $10^{-17}$ mho-cm$^{-1}$ as measured, for example, across a 0.1 inch magnetic brush at an applied potential of 10 volts; and wherein the coating coverage encompasses from about 10 percent to about 100 percent of the carrier core. Moreover, known solution processes may be selected for the preparation of the coated carriers.

Illustrative examples of toner binders, include thermoplastic resins, which when admixed with the carrier generates developer compositions, such binders including styrene based resins, styrene acrylates, styrene methacrylates, styrene butadienes, polyamides, epoxies, polyurethanes, diolefins, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated mono-olefins, such as ethylene, propylene, butylene and isobutylene; vinyl halides, such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments dyes, or mixtures thereof, and preferably pigments can be selected as the colorant for the toner particles including, for example, carbon black, nigrosine dye, lamp black, iron oxides, magnetites, and mixtures thereof, known cyan, magenta, yellow pigments, and dyes. The colorant, which is preferably carbon black, should be present in a sufficient amount to render the toner composition highly colored. Thus, the colorant can be present in amounts of, for example, from about 1 percent by weight to about 20, and preferably from about 5 to about 12 percent by weight, based on the total weight of the toner components, however, lesser or greater amounts of colorant may be selected. Illustrative examples of magentas that may be selected include 1,9-dimethyl-substituted quinacridone and anthraquinone dye identified in the Color Index as CI 60720, CI Dispersed Red 15, a diazo dye identified in the Color Index as CI 26050, CI Solvent Red 19, Pigment Blue 15:3, and the like. Examples of cyans that may be used include copper tetra4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy4-sulfonanilide phenylazo-4'-chloro-2,5-dimethoxy acetoacetanilide, permanent yellow FGL, and the like. Other known suitable colorants, such as reds, blues, browns, greens, oranges, and the like, inclusive of known suitable dyes thereof can be selected. These colorants are generally present in the toner composition in an amount of from about 1 weight percent to about 15, and, for example, from about 2 to about 12 weight percent based on the weight of the toner components of binder and colorant.

When the colorant particles are comprised of magnetites, which are a mixture of iron oxides ($FeO.Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

Colorant includes pigment, dye, mixtures thereof, mixtures of pigments, mixtures of dyes, and the like.

The resin particles are present in a sufficient, but effective amount, thus when 10 percent by weight of pigment, or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

For further enhancing the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and, for example, from about 3 to about 12 percent by weight. These charge additives can also be dispersed in the carrier polymer coating as indicated herein.

The toner composition of the present invention can be prepared by a number of known methods including melt blending the toner resin particles, and colorants of the present invention followed by mechanical attrition, in situ emulsion/aggregation/coalescence, reference U.S. Pat. Nos. 5,370,963; 5,344,738; 5,403,693; 5,418,108; 5,364,729 and 5,405,728, the disclosures of which are totally incorporated herein by reference, and the like. Other methods include those well known in the art such as spray drying, melt dispersion, dispersion polymerization and suspension polymerization. In one dispersion polymerization method, a solvent dispersion of the resin particles and the colorant are spray dried under controlled conditions to result in the desired product. Toner particles sizes and shapes are known and include, for example, a toner size of from about 2 to about 25, and preferably from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990, 4,585,884, 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members are conventionally charged negatively thus requiring a positively charged toner.

Images, especially colored images obtained with the developer compositions of the present invention in embodiments possess, for example, acceptable solids, excellent halftones, and desirable line resolution with acceptable or substantially no background deposits, excellent chroma, superior color intensity, constant color chroma and intensity over extended time periods, such as 1,000,000 imaging cycles, and the like.

The following Examples are being provided to further define the present invention, it being noted that these Examples are intended to illustrate and not limit the scope of the present invention. Parts and percentages are by weight unless otherwise indicated.

COMPARATIVE EXAMPLE I

One gram of PMMA (polymethylmethacrylate) polymer containing 18 weight percent of carbon black was dissolved in a solvent of tetrahydrofuran (THF) 50 grams of solvent. One hundred grams of nuclear metals 100 micron diameter carrier core particles were preheated in an oven to about 125° C. The above polymer solution was then added to the hot core with stirring. The resulting mixture was then dispersed on a tray and dried in vacuum overnight, about 18 hours.

A xerographic developer composition was then prepared by adding 1 gram of a 9 micron volume median diameter toner composition to the above coated carrier. The toner composition was comprised of a 30 percent by weight gel content of a partially crosslinked polyester resin, reference U.S. Pat. No. 5,376,494, the disclosure of which is totally incorporated herein by reference, obtained by the reactive extrusion of a linear bisphenol A propylene oxide fumarate polymer and pigment of 0.4 weight percent REGAL 330® carbon black obtained from Cabot Inc. and TS530, an external silica additive. The developer composition was then conditioned overnight at 50 percent relative humidity, and was subsequently charged on a paint shaker. The carrier charge was determined after 15 minutes and after 90 minutes of charging to primarily determine the stability of the charge to very aggressive mixing using the known Faraday Cage process. There was measured on the carrier a positive charge of 14.7 microcoulombs per gram after 15 minutes of mixing and 13.9 microcoulombs per gram after 90 minutes of mixing. Further, the conductivity of the carrier as determined by forming a 0.1 inch long magnetic brush off carrier particles, and measuring the conductivity by imposing a 10 volt potential across the brush was $2.3\times10^{-9}$ (ohm-cm)$^{-1}$.

EXAMPLE II

One gram of a poly(ferrocenyl dimethylsilane), [Fc—Si$(CH_3)_2$], with an $M_n$ and $M_w>10^5$, greater than $10^5$ like $10^6$, and which dimethylsilane was obtained from Professor Ian Manners, Department of Chemistry, University of Toronto, was dissolved in THF about 50 grams of solvent. One hundred grams of nuclear metals, 100 micron diameter carrier core particles were preheated in an oven to 125° C. The above prepared polymer solution was then added to the above hot core with stirring. The mixture was then dispersed on a metal tray and dried in vacuum overnight.

A xerographic developer composition was then prepared and charged as described in Comparative Example I, producing a positive carrier charge of 14.2 microcoulombs per gram after 15 minutes of mixing and 13.2 microcoulombs per gram after 90 minutes of mixing. Further, the conductivity of the carrier was measured as $3.5\times10^{-9}$ (ohm-cm)$^{-1}$. Thus, Example II illustrates that with the inventive polymer composition as a carrier coating material, substantially the same charge and conductivity can be obtained as for the reference coating material, without the addition of an additional conductive additive, such as carbon black, that was used in Comparative Example I.

EXAMPLE III

Seven-tenths gram of poly(ferrocenyl dimethylsilane), [Fc—Si$(CH_3)_2$], and three-tenths gram of poly(ferrocene), both obtained from Professor Ian Manners, Department of Chemistry, University of Toronto, were dissolved in THF about 25 grams of solvent. One hundred grams of nuclear metals 90 micron carrier core particles were preheated in an oven to 125° C. The polymer solution was then added to the hot core with stirring. The mixture was then dispersed on a metal tray and dried in vacuum overnight.

A xerographic developer composition was then prepared and charged as described in Comparative Example I, producing a carrier positive charge of 26.3 microcoulombs per gram after 15 minutes of mixing and 14.2 microcoulombs per gram after 90 minutes of mixing. Further, the conductivity of the carrier was measured as $5\times10^{-11}$ (ohm-cm)$^{-1}$. Thus, Example III illustrates that with the inventive polymer composition as a carrier coating material, substantially higher initial charge can be obtained and somewhat lower conductivity can be obtained compared to the reference coating material, without the addition of an additional conductive additive, such as carbon black, used in Comparative Example I.

Other modifications of the present invention may occur to those skilled in the art subsequent to a review of the present application and these modifications, including equivalents thereof, are intended to be included within the scope of the present invention.

What is claimed is:

1. A carrier comprised of a core and thereover a ferrocene containing polymer.

2. A carrier comprised of a core and thereover ferrocene containing polymers.

3. A carrier in accordance with claim 1 wherein said ferrocene containing polymer is poly(ferrocenyl dimethylsilane), poly(ferrocenyl phenylphosphane), or mixtures thereof.

4. A carrier in accordance with claim 1 wherein said ferrocene is a ferrocenylsilane, a mixture of poly(ferrocenyl dimethylsilane) and poly(ferrocenyl phenylphosphane), or a mixture of poly(ferrocenyl dimethylsilane) poly(ferrocenyl phenylphosphane), and poly(ferrocenyl dimethylgermane).

5. A carrier in accordance with claim 1 wherein the polymer possesses an $M_w$ of from about $10^5$ to about $10^7$ and an $M_n$ of from about $10^5$ to about $10^7$.

6. A carrier in accordance with claim 1 wherein the polymer coating weight is from about 0.1 to about 20 weight percent.

7. A carrier in accordance with claim 1 wherein the polymer coating weight is from about 1 to about 3 weight percent.

8. A carrier in accordance with claim 1 wherein the polymer contains a conductive component.

9. A carrier in accordance with claim 8 wherein the conductive component is a metal oxide, or is carbon black.

10. A carrier in accordance with claim 9 wherein said conductive component is carbon black selected in an amount of from about 10 to about 60 weight percent.

11. A carrier in accordance with claim 1 wherein said core is a metal, a metal oxide, or a ferrite.

12. A carrier in accordance with claim 1 with a triboelectric charge of from about 15 to about a positive 50 microcoulombs per gram.

13. A carrier in accordance with claim 1 with a triboelectric charge of from about 15 to about 30 microcoulombs per gram.

14. A developer comprised of the carrier of claim 1 and toner.

15. A developer in accordance with claim 14 wherein the toner is comprised of thermoplastic resin and colorant.

16. A developer in accordance with claim 14 wherein the colorant is a pigment and the resin is a styrene copolymer, or a polyester.

17. A developer comprised of a (1) carrier core and coating layer of a ferrocene containing polymer, and (2) a toner.

18. A developer in accordance with claim 17 wherein the carrier core is selected from the group consisting of iron, ferrites, steel and nickel.

19. A developer in accordance with claim 17 with a carrier triboelectric charge of from about a positive 15 to about a positive 50 microcoulombs per gram, and a toner triboelectric charge of from about a negative 15 to about a negative 50 microcoulombs per gram.

20. A developer in accordance with claim 17 with a carrier triboelectric charge of from about a negative 15 to about a negative 50 microcoulombs per gram, and a toner triboelectric charge of from about a positive 15 to about a positive 50 microcoulombs per gram.

21. A carrier in accordance with claim 1 wherein there is included as a coating a second polymer of a copolymer of methylmethacrylate/dimethylaminoethyl methacrylate; a copolymer of methylmethacrylate and tertiary-butylaminoethyl methacrylate; a copolymer of methylmethacrylate and diethylaminoethyl methacrylate; a copolymer of methylmethacrylate and diisopropylaminoethyl methacrylate; or a copolymer of methylmethacrylate and an alkylaminoethyl methacrylate.

22. A carrier in accordance with claim 1 wherein the carrier contains a second polymer coating.

23. A carrier in accordance with claim 22 wherein the second coating is comprised of a styrene acrylate, a styrene methacrylate, or a fluoropolymer.

24. A carrier in accordance with claim 22 wherein said second coating is comprised of a polyurethane.

25. A carrier in accordance with claim 22 wherein the second coating is comprised of a polyurethane/polyester.

26. An imaging process which comprises developing an image with the developer of claim 22.

27. A process for the preparation of the carrier of claim 1 by the dry mixing and heating of said core and said coating.

28. A carrier in accordance with claim 1 wherein said ferrocene polymer is of the formula

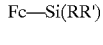

Fc—Si(RR')

wherein Fc is ferrocene, and R and R' are each alkyl, or aryl.

29. A carrier in accordance with claim 1 wherein said ferrocene polymer is of the formula FcPR wherein Fc is ferrocene, P is phosphorous, and R is alkyl or aryl.

30. A carrier in accordance with claim 1 wherein said ferrocene polymer is poly(ferrocenyl dimethyl silane), poly (ferrocenyl di-n-hexyl silane), poly(ferrocenyl phenyl phosphone), or mixtures thereof.

* * * * *